United States Patent [19]

Kimpara

[11] Patent Number: 4,862,784

[45] Date of Patent: Sep. 5, 1989

[54] ELECTRONIC MUSICAL INSTRUMENT

[75] Inventor: Mamoru Kimpara, Hamamatsu, Japan

[73] Assignee: Yamaha Corporation, Hamamatsu, Japan

[21] Appl. No.: 297,601

[22] Filed: Jan. 17, 1989

[30] Foreign Application Priority Data

Jan. 14, 1988 [JP] Japan ..... 63-6419
Jan. 14, 1988 [JP] Japan ..... 63-6420

[51] Int. Cl.[4] ..... G10H 1/06; G10H 1/18; G10H 5/00

[52] U.S. Cl. ..... 84/622; 84/634

[58] Field of Search ..... 84/1.01, 1.17, 1.19–1.23

[56] References Cited

U.S. PATENT DOCUMENTS

Re. 30,834 12/1981 Niimi et al. ..... 84/1.01
4,213,366 7/1980 Niimi et al. ..... 84/1.01
4,476,766 10/1984 Ishii ..... 84/1.19 X
4,773,294 9/1988 Iizuka et al. ..... 84/1.01
4,788,896 12/1988 Uchiyama et al. ..... 84/1.01

*Primary Examiner*—Stanley J. Witkowski
*Attorney, Agent, or Firm*—Spensley Horn Jubas & Lubitz

[57] ABSTRACT

An electronic musical instrument providing a key area dividing unit and a tone area changing unit divides the whole key area of a keyboard into melody key area and accompaniment key area when a diving mode is designated by a player. A tone area of tone pitch information which is generated from each key area can be arbitrarily determined or changed by a manual operation of player. In addition, several kinds of tone colors are respectively assigned to plural tone color switches so that the player can select any one of the tone colors by operating one of plural tone color switches. Based on the selected tone color and tone pitch information, a musical tone signal can be generated in each key area of keyboard.

7 Claims, 6 Drawing Sheets

| KEY | $C^{\#}_{-2}$ --- $C_0$ --- $C_2$ $C^{\#}_2$ --- $F^{\#}_2$ --- $B_2$ $C_3$ --- $C_4$ --- $C_6$ --- $C_8$ --- $G_8$ |
|---|---|
| KEY CODE | 1 --- 24 --- 48 49 --- 54 --- 59 60 --- 72 --- 96 --- 120 --- 127 |
FIG. 2
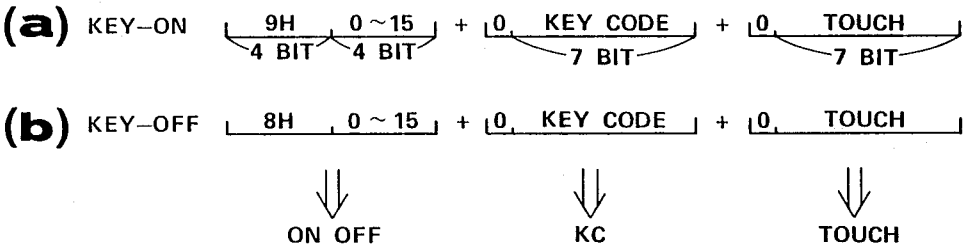
FIG. 3 (MIDI INPUT DATA)
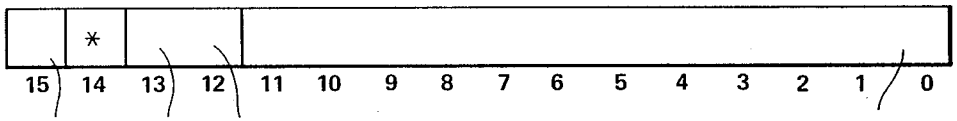
FIG. 4 (16-BIT REGISTER)

(MAIN ROUTINE PROCESS)

(SUBROUTINE "TONE SW")

(SUBROUTINE "PITCH · SW")

(SUBROUTINE "MIDI - IN")

ELECTRONIC MUSICAL INSTRUMENT

BACKGROUND OF THE INVENTION

1. Field of the Invention

The present invention relates to an electronic musical instrument, and more particularly to an electronic musical instrument having a keyboard whose key area can be divided for accompaniment and melody.

2. Prior Art

Conventionally, the electronic musical instrument provides a key area dividing unit by which the key area of keyboard is divided into two areas which are respectively used for the accompaniment and melody. In the key area for accompaniment, chord designation of automatic accompaniment and bass performance are executed in general (see Japanese Patent Laid-Open Publication No. 54-158216).

However, the above-mentioned key area diving unit must require a switch operation for setting the predetermined mode when the key area is to be divided. In addition, tone color setting of each key area must be executed by another independent operation. For this reason, the conventional electronic musical instrument is disadvantageous in that the operations of diving the key area must be complicated.

Meanwhile, the conventional electronic musical instrument may provide a tone area changing unit capable of changing the tone area of each divided key area as disclosed in Japanese Patent Publication No. 62-35118. This unit changes the tone area of each key area such that certain tone pitches will be assigned to both key areas. For example, certain tone pitches of melody performance can be set identical to those of chord performance. Thus, the electronic musical instrument having a single-stage keyboard can obtain the same performance effect of the electronic musical instrument having a plural-stage keyboard.

However, since the tone area of each divided key area is fixed in advance, freedom degree of changing the tone area must be limited. For example, it is impossible to change the tone area to the desirable tone area which is suitable for the tune to be performed by each time. In addition, the conventional tone area changing unit changes the tone areas such that these tone areas will be partially coincided with each other. Therefore, it is impossible to play the performance based on melody tones in upper key area and bass tones in lower key area whose tone pitches are respectively separated from each other.

SUMMARY OF THE INVENTION

It is accordingly a primary object of the present invention to provide an electronic musical instrument in which the setting operation of diving mode and tone color setting operation can be executed with ease.

It is another object of the present invention to provide an electronic musical instrument in which the tone area of at least one key area can be freely changed.

In a first aspect of the invention, there is provided an electronic musical instrument providing a key area diving unit comprising:

(a) a plurality of tone color setting members each designating a predetermined tone color;

(b) detecting means for detecting a simultaneous operation in which more than two tone color setting members are simultaneously operated;

(c) means for designating a dividing mode so that a key area of keyboard is divided when the detecting means detects the simultaneous operation;

(d) musical tone generating means having a plurality of tone generation channels from which a musical tone signal will be generated in accordance with tone pitch information;

(e) tone color setting means for setting the tone color designated by each tone color setting member to each tone-generation channel in response to divided key area in the diving mode; and (f) assigning means for assigning the tone pitch information to each tone-generation channel in response to the divided key area in the dividing mode.

In a second aspect of the invention, there is provided an electronic musical instrument providing a tone area changing unit comprising:

(a) designating means for designating a dividing mode by which a key area of keyboard is divided into first and second key areas;

(b) means for discriminating the key area so that tone pitch information are divided into first and second tone pitch informations having first and second tone areas which are outputted in response to the first and second key areas, the tone pitch information being supplied to the means when the dividing mode is designated;

(c) tone areas changing means for changing the first tone area of the first tone pitch information for the first key area;

(d) variation designating means for designating a variation of the first tone area which is changed by the tone area changing means;

(e) first musical tone signal generating means for generating a first musical tone signal based on the second tone pitch information outputted from the means; and (f) second musical tone signal generating means for generating a second musical tone signal based on the output of the tone area changing means.

In a third aspect of the invention, there is provided an electronic musical instrument comprising:

(a) a keyboard (b) tone color setting means to which several kinds of tone colors are predetermined in advance so that each of the tone colors can be arbitrarily designated by manual operation of a player, the tone color setting means pre-storing tone color parameters in response to the predetermined tone colors, the tone color parameter being outputted when the corresponding tone color is designated by the player;

(c) mode designating means capable of designating a dividing mode by which a whole key area of the keyboard is divided into at least first and second key areas;

(d) means for dividing tone pitch information into first and second tone pitch informations which are to be respectively outputted in response to the first and second key areas in the diving mode, the tone pitch information being generated from the keyboard under performance of the keyboard;

(e) tone pitch changing means for changing a tone area of at least one tone pitch information to thereby output changed tone pitch information in the dividing mode; and (f) musical tone signal generating means having a plurality of channels to which the first and second tone pitch informations are assigned in response to the first and second key areas, whereby each channel generates and outputs a musical tone signal based on the assigned tone pitch information and supplied tone color parameter.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 2 shows the relation between key codes and tone pitches in the present embodiment;

FIG. 3 shows a format of MIDI signal;

FIG. 4 shows the function of each bit in a 16-bit register;

DESCRIPTION OF A PREFERRED EMBODIMENT

Next, description will be given with respect to an embodiment of the present invention in conjunction with FIGS. 1 to 8.

[A] CONSTITUTION OF EMBODIMENT

Figure 1:
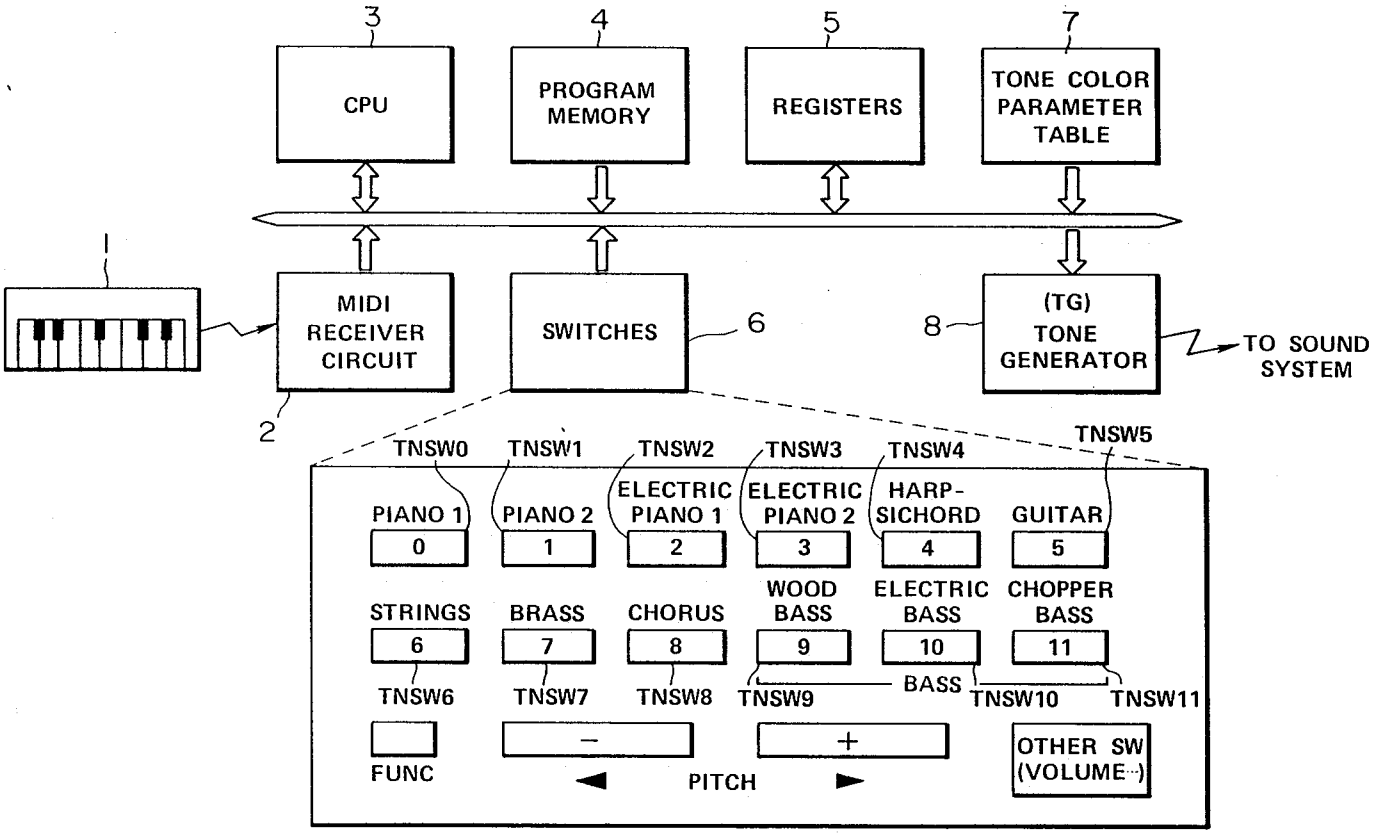
FIG. 1 is a block diagram showing an electronic musical instrument according to an embodiment of the present invention.

FIG. 1 is a block diagram showing the constitution of an embodiment of the present invention. In FIG. 1, 1 designates a keyboard of electronic musical instrument which generates a musical tone control signal of MIDI (Musical Instrument Digital Instrument) standard in response to a depressing operation of each key thereof. Next, description will be given with respect to this signal (hereinafter, referred simply to "MIDI signal"). This MIDI signal is a series of signals each consisting of three bytes. As shown in FIGS. 3(*a*) and 3(b), the first byte designates a key-on/off, second byte designates a key code and third byte designates touch information. More specifically, upper four bits of first byte having a value ($9_H$) designates the key-on, while those of first byte having a value ($8_H$) designates a key-off. In addition, lower four bits of first byte designate a communication channel. Further, the value "0" is written at the most significant bit (MSB) of the second and third bytes. Lower seven bits of second byte designate the key code, while lower seven bits of the third byte designate the touch information. The key code means the code indicative of the tone pitch of key, and these key codes have the relation with the keys as shown in FIG. 2.

In FIG. 1, 2 designates a MIDI receiver circuit for receiving the MIDI signal, which will then be supplied to a central processing unit (CPU) 3. The CPU 3 controls several portions of the apparatus shown in FIG. 1 in accordance with programs stored in a program memory 4. Registers 5 include several registers and flags which will be described later, and the registers 5 are constituted by a random access memory (RAM). 6 designates switches for designating several commands for the CPU 3. The switches 6 include twelve tone color switches TNSW0 and TNSW11, a function switch FUNC, pitch switches PITCH (+) and (−) and other switches (such as a volume switch etc.).

The tone color switches TNSW0 to TNSW11 are divided into two groups wherein the first group includes the tone color switches TNSW0 to TNSW8 and the second group includes the tone color switches TNSW9 to TNSW11 for designating the bass tone colors. Each tone color switch is turned on by depressing and turned off by releasing. In the same group of tone color switches, one operation of tone color switch is only executed at one time based on the latter-first-priority. In other words, when two tone color switches are operated, the former operation is neglected but the latter operation is accepted. In addition, a tone color parameter table 7 pre-stores tone color parameters corresponding to the tone colors (such as the tone colors of "piano 1", "piano 2", . . . , "chopper bass") which are respectively designated by the tone color switches TNSW0 to TNSW9. When any one of the operations of tone color switches is accepted, the tone color parameter of such accepted tone color switch is read from this table 7. In this case, the tone parameters have respective identification numbers "0" to "11" respectively corresponding to the tone color switches TNSW0 to TNSW11. Hence, when the certain tone color switch is depressed, its corresponding identification number is outputted from the CPU 3. Based on the outputted identification number, the corresponding tone color parameter will be read from the table 7. The function switch FUNC is depressed in combination with other switches in order to designate several functions. Further, the tone pitch of the musical tone to be generated is raised by half-tone (i.e., chromatic semitone) at every time when the pitch switch PITCH(+) is depressed, while such tone pitch is lowered by half-tone at every time when the pitch switch PITCH(−) is depressed.

Next, a tone generator 8 provides eight tone-generation channels ch0 to ch7. When the key code outputted from the keyboard 1 is assigned to one of these eight tone-generation channels ch0 to ch7 by the CPU 3, such assigned tone-generation channel generates the musical tone signal whose tone pitch is designated by each key mode. In addition, the tone color parameters read from table 7 are supplied to the tone-generation channels ch0 to ch7 via the CPU 3, so that each tone-generation channel will generate the musical tone signal having the tone color corresponding to the supplied tone color parameter. The musical tone signal outputted from the tone generator 8 is supplied to a sound system (not shown) wherein the corresponding musical tone will be generated. Four tone-generation channels ch0 to ch3 are used for upper key area, while other four tone-generation channels ch4 to ch7 are used for lower key area.

Next, description will be given with respect to the registers and flags which are mainly used in the registers 7 as follows:

Register ASS for designating the assignment of tone-generation channels, wherein its stored value designates the number of tone-generation channel, Register KC to which the key code within the MIDI signal is written in, Key code buffers KCBUF (0 to 7) each provided for each tone-generation channel and each storing the assigned key code, Register SWST which is the 16-bit register for storing the states of switches as shown in FIG. 4, Register TNST whose constitution is roughly similar to that of the register SWST but which only stores the states of tone color switches TNSW0 to TNSW11, Register TNEV for storing on-events of the tone color switches only, Register SPLTKC to which a boundary key code of the divided key area is written, wherein the key having the highest tone pitch in the lower key area is to be written in, and Flag SPLT whose value is changed to "1" in the key area diving mode.

In addition, as shown in FIG. 4, 0-bit to 11-bit of the register SWST respectively correspond to the tone color switches TNSW0 to TNSW11; 12-bit and 13-bit respectively correspond to the pitch switch PITCH(+) and PITCH(−); and the MSB corresponds to the function switch FUNC. The value of each bit turns to "1" when the corresponding switch is depressed. Meanwhile, other registers SWOLD and SWONEV etc. are provided as similar to this 16-bit register SWST. The register SWOLD stores the preceding states of switches, while each bit of the register SWONEV is turned on when the on-event of corresponding switch is occurred. This co-event means the situation where the state of switch is changed from "off" state to "on" state.

[B] OPERATION OF EMBODIMENT

Next, description will be given with respect to the operation of the present embodiment.

(1) MAIN ROUTINE PROCESS

Figure 5:
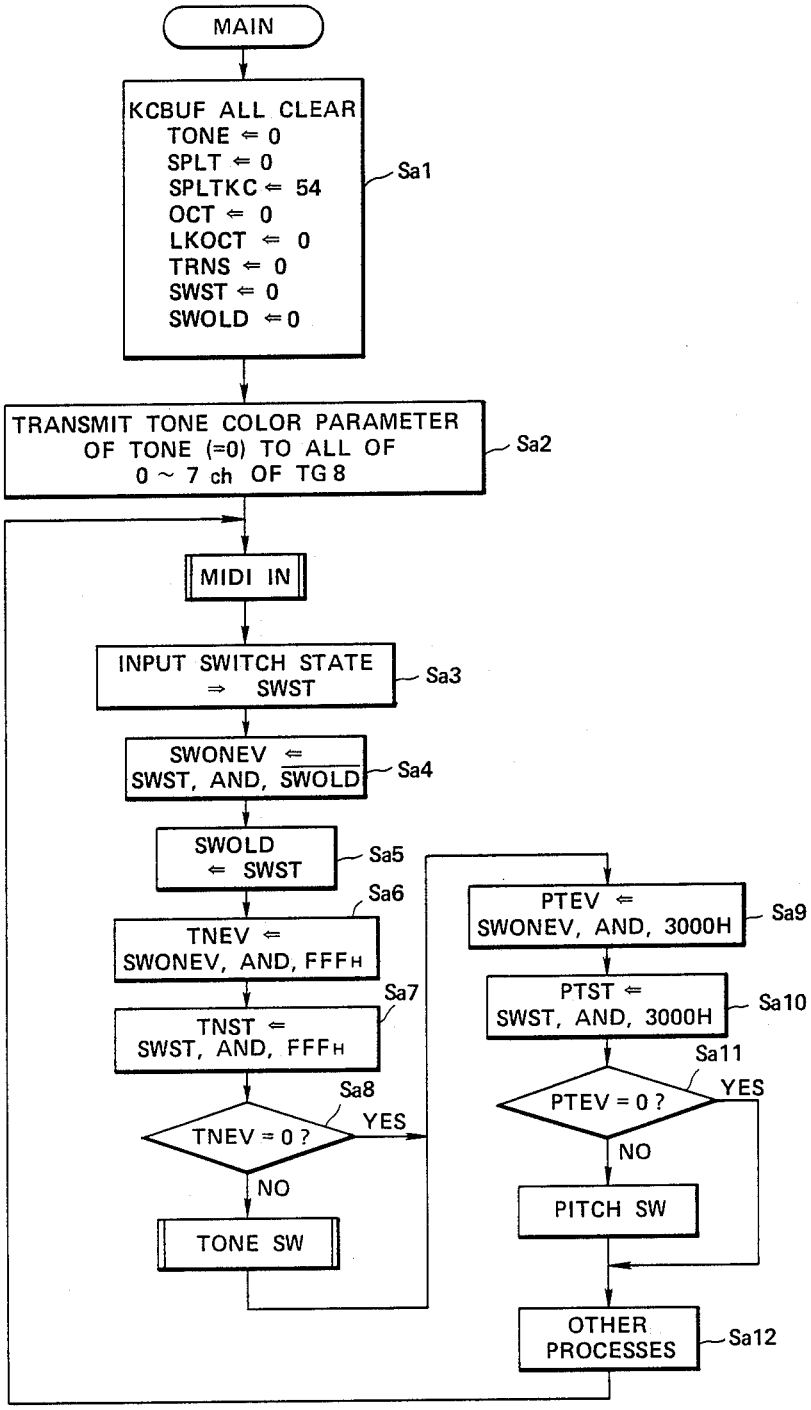
FIG. 5 is a flowchart showing a main routine process of the present embodiment.

FIG. 5 is a flowchart showing the main routine process "MAIN" of the present embodiment.

First, in a step Sa1, several registers are initialized. More specifically, the flag PLT, register SWST and register SWOLD are cleared, while a value "54" is written into the register SPLTKC. Since the register SPLT is cleared, a whole key area mode is set instead of a spirit mode (i.e., a diving mode). Since the value "54" is set to the register SPLTKC, the key area is divided by setting a key $F\#_2$ as the boundary when the spirit mode is set at first. Next, the processing proceeds to a step Sa2 wherein the tone color parameter corresponding to the contents of data stored in the register TONE are read from the tone color parameter table 7 and then the read tone color parameter is supplied to the tone-generation channels ch0 to ch7. Since the value "0" is written in the register TONE in the step Sa1, the tone color parameter to be written in the tone-generation channels ch0 to ch7 is the tone color parameter indicative of "piano 1" (see FIG. 1). After executing the step Sa2, the CPU 3 will execute a subroutine process called "MIDI-IN". This subroutine process executes generation of musical tone signal based on the MIDI signal supplied from the keyboard 1, the detailed description of which will be described later.

Next, the processing proceeds to a step Sa3 wherein the switching states of switches 6 are inputted to the register SWST, and then a logical product (i.e., AND operation) between each bit of data stored in the register SWST and each inverted bit of data stored in the register SWSTOLD is obtained so that its logical product result is written into the register SWONEV by each bit in a next step Sa4. Since the register SWSTOLD has been cleared in the step Sa1, its inverted data must be identical to data $(FFFF)_H$. Therefore, in the step Sa4, the value of logical product corresponding to the bit having the value "1" within the data stored in the register SWST must become equal to "1". In other words, in the data stored in the register SWONEV, the bit corresponding to the switch whose on-event is occurred must take the value "1". Next, the data of register SWST are written into the register SWOLD in a step Sa5. Thereafter, the operation of step Sa4 must be executed between the inverted data of preceding switching states and the data of new switching states. In this case, the bit corresponding to the switch whose on-event is occurred must take the value "1" in the data of logical product. After executing the step Sa5, the processing proceeds to a step Sa6 wherein the AND operation is executed between the data of register SWONEV and the data $(0FFF)_H$. Due to this operation, the tone color switches whose on-events are occurred are extracted from the switches TNSW0 to TNSW11. The result of this operation is written into the register TNEV. Then, the AND operation is executed between the data of register SWST and data $(0FFF)_H$ in a step Sa7. Due to this operation, the on states of the tone color switches TNSW0 to TNSW11 are only extracted. The result of this operation will be written into the register TNST.

Next, the processing proceeds to a step Sa8 wherein it is judged whether the value of data stored in the register TNEV is equal to "0" or not. If the judgement result of this step Sa8 is "YES", it is judged that there is no on-event in the tone color switches TNSW0 to TNSW11. If the on-event is occurred in any one of these switches TNSW0 to TNSW11, the processing proceeds to the subroutine process called "TONE-SW" for executing its on-event process. Meanwhile, if the judgement result of step Sa8 is "YES", the processing proceeds to a step Sa9 wherein the AND operation is executed between the data of register SWONEV and data $(3000)_H$. Due to this operation, the on-event of pitch switch PITCH(+) or (−), and then its operation result will be written into the register PTEV. Then, the AND operation is executed between the data of register SWST and data $(3000)_H$. Due to this operation, the on state of the pitch switch PITCH(+) or (−) is further extracted, and then its result will be written into the register PTST. In a next step Sa11, it is judged whether the value of data stored in the register PTEV is equal to "0" or not. If the judgement result of this step Sa11 is "YES", it is judged that there is no on-event in the pitch switches PITCH(+) and (−). If there is the on-event in any one of these pitch switches, the judgement step of step Sa11 turns to "NO" so that the processing proceeds to the subroutine process called "PITCH-SW" wherein the on-event process of pitch switch will be executed. Meanwhile, if the judgement result of step Sa11 turns to "YES", the processing directly proceeds to a step Sa12 wherein other processes corresponding to the operation of tone volume switch and the like will be executed. Then, the processing returns to the subroutine process MIDI-IN. Thereafter, the above-mentioned circulating processes are repeatedly executed.

(2) SUBROUTINE PROCESS TONE-SW

Next, description will be given with respect to the subroutine process TONE-SW by referring to FIG. 6. As described before, this subroutine process TONE-SW is started when the on-event is occurred in any one of the tone color switches TNSW0 to TNSW11. In this case, there is the possibility in that two tone color switches can be simultaneously depressed. However, the foregoing processes such as MAIN are executed with high speed by the system clock and two depressing operations by human must be differed by minute time difference so that the subroutine process TONE-SW must be started immediately after the on-event of any one of the tone color switches is detected.

First, a register i whose value is used as a control variable is cleared in a step Sb1, and then the processing proceeds to a next step Sb2 wherein it is judged whether an i-bit value of register TNEV is equal to "1" or not. If the judgement result of this step Sb2 is "NO", the register value i is incremented by "1" and then the judging process of step Sb is repeatedly executed. Thereafter, until the judgement result of step Sb2 turns to "YES", the processes in the loop consisting of the steps Sb2 and Sb3 is repeatedly executed. Then, when the judgement result of step Sb2 turns to "YES", the processing proceeds to a step Sb4 wherein the register value i is written into the register NO. Due to these processes described above, the value written into the register NO must become identical to the number of the tone color switch whose on-event is occurred. More specifically, in the processes of steps Sb2 to Sb4, the bit where the on-event is occurred in the corresponding switch is searched in the data of register TNEV from its lower bit side, and then the number of tone color switch whose on-event is occurred will be written into the register NO.

Next the processing proceeds to a step Sb5 wherein it is judged whether the value written into register NO is equal to or lower than the value "8" or not. Due to this judging process of step Sb5, it is judged whether the on-event is occurred in the tone color switches TNSW0 to TNSW8 or the tone color switches TNSW9 to TNSW11 for controlling the bass tone colors. If the judgement result of this step Sb5 turns to "NO", the on-event must be occurred in the bass tone color switches TNSW9 to TNSW11. On the other hand, if the judgement result of step Sb5 turns to "YES", the processing proceeds to a step Sb6 wherein the AND operation is executed between the data of register TNST and data $(0E00)_H$, and then its operation result will be written into a register TSWL. Due to this operation, the on-event in the bass tone color switches TNSW9 to TNSW11 is extracted. Next, it is judged whether the value of register TSWL is equal to "0" or not in a step Sb7. When the judgement result of this step Sb7 turns to "YES", any one of the tone color switches TNSW0 to TNSW8 is depressed but the bass tone color switches TNSW9 to TNSW11 are not depressed. In this case, the processing proceeds to a step Sb10. On the other hand, when the judgement result of step Sb7 turns to "NO", any one of the tone color switches TNSW0 to TNSW8 and any of the bass tone color switches TNSW9 to TNSW11 are both depressed. In this case, the processing proceeds to a step Sb13. However, due to the time difference between the depressing operations of humans, the judgement result of step Sb7 must initially turn to "YES" so that the processing will proceed to the step Sb10 even if two kinds of tone color switches are simultaneously depressed.

When the judgement result of step Sb5 turns to "NO", the processing proceeds to a step Sb8 wherein the AND operation is executed between the data of register TNST and data $(01FF)_H$, and then its operation result is written into a register TSWU. This operation is used for extracting the on states of the tone color switches TNSW0 to TNSW8. Then it is judged whether the value of register TSWU is equal to "0" or not in a step Sb9. The judgement result "YES" of this step Sb9 means that the bass tone color switch is depressed but other tone color switch is not depressed, so that the processing proceeds to a step Sb18. On the contrary, when the judgement result of step Sb9 turns to "NO", any one of the bass tone color switches TNSW9 to TNSW11 and any one of the tone color switches TNSW0 to TNSW8 are both depressed. Similar to the case of the step Sb7, the judgement result of step Sb9 initially turns to "YES", so that the processing will proceed to the step Sb10.

In the step Sb10, the flag SPLT is cleared so that the spirit mode will be stopped. Then, the data of register NO are written into the register TONE in a step Sb11. The value of data stored in the register NO is set identical to the number of switch whose on-event is occurred (see step Sb4). In a next step Sb12, the tone color parameter corresponding to the value of data stored in the register NO is read from the table 7, and then the read tone color parameter is supplied to the tone-generation channels ch0 to ch7 in the tone generator 8. As a result, the tone color of whole key area is set identical to the depressed tone color switch. Thereafter, the processing returns to the main routine process MAIN. Next, when another tone color switch other than the above depressed tone color switch is newly depressed, the processes as described above are repeatedly executed so that the tone color of whole key area is newly reset to the tone color of newly depressed tone color switch.

Meanwhile, when the tone color switch (TNSW0 to TNSW8) and bass tone color switch (TNSW9 to TNSW11) are both depressed, the following process (i) or (ii) is to be executed.

(i) THE CASE WHERE ON-EVENT OF BASS TONE COLOR SWITCH (TNSW9 TO TNSW11) IS DETECTED PRIOR TO ON-EVENT OF TONE COLOR SWITCH (TNSW0 TO TNSW8)

In this case, the process consisting of the steps Sb5, Sb8, Sb9, Sb10, Sb11, and Sb12 are executed in a first processing time of TONE-SW so that the tone color of whole key area is set as the bass tone color such as "wood bass", "electric bass" or "chopper bass". In a second processing time of TONE-SW, the number of tone color switch (TNSW0 to TNSW8) whose on-event is occurred is written into the register NO so that the processes of steps Sb5 to Sb7 are executed, whereby the processing will proceed to a step Sb13 based on the judgement result "NO" of step Sb7.

In the step Sb13, the value "1" is set to the flag SPLT so that the spirit mode is set. Next, the data of register TONE is written into the register TONEL in a step Sb14. This register TONEL is used for designating the tone color of lower key areas. The reason why this step Sb14 is executed is that the bass tone color data written in the register TONE in the step Sb11 in the first processing time of subroutine process TONE-SW are rewritten into the register TONEL for designating the bass tone color. In a next step Sb15, the number indicated by the data of register NO is written into the register TONE. Then, the processing proceeds to a step Sb16 wherein the tone color parameter corresponding to the value of data stored in the register TONE is written into the tone-generation channels ch0 to ch3, while another tone color parameter corresponding to the value stored in the register TONEL is written into the tone-generation channels ch4 to ch7. Thus, the bass tone color is set to the tone-generation channels ch4 to ch7 but the general tone color other than the bass tone color is set to the tone-generation channels ch0 to ch3. Thereafter, the processing returns to the main routine process MAIN again, (ii) THE CASE WHERE ON-EVENT OF BASS TONE COLOR SWITCH (TNSW9 TO TNSW11) IS DETECTED LATER In this case, the processes of steps Sb5 to Sb7 and Sb10 to Sb12 are executed in the first processing time of subroutine process TONE-SW so that the tone color such as "piano 1", "strings", "chorus" and the like (see FIG. 1) is set as the tone color of whole key area. In the second processing time of subroutine process TONE-SW, the number of bass tone color switch (TNSW9 to TNSW11) whose on-event is occurred is written into the register NO in the step Sb4. Then, the processes of steps Sb5 to Sb9 are executed, whereby the processing will proceed to a step Sb18 based on the judgement result "NO" of step Sb9. In the step Sb18, the value "1" is set to the flag SPLT so that the spirit mode is set. In a next step Sb19, the value of data stored in the register NO is written into the register TONEL. Then the tone color parameter corresponding to the value of data stored in the register TONEL is set to the tone-generation channels ch4 to ch7 in a step Sb20. In this case, certain tone color parameter is written into the tone-generation channels ch0 to ch3 in the step Sb11 of the first processing time. Therefore, after executing the process of step Sb20, the bass tone color is set to the tone-generation channels ch4 to ch7, while the general tone color is set to the tone-generation channels ch0 to ch3. Thereafter, the processing will return to the main routine process MAIN.

(3) SUBROUTINE PROCESS PITCH-SW

Next, description will be given with respect to the subroutine process PITCH-SW by referring to FIG. 7.

First, description will be given with respect to the case where the pitch switch PITCH(+) or (−). When one of the pitch switches PITCH(+) and (−) is depressed, the tone pitch of the whole key area is raised or lowered by half-tone every time the pitch switch is depressed. When one pitch switch and function switch FUNC are simultaneously depressed, the tone pitch of upper key area is raised or lower by octave. When one pitch switch and one bass tone color switch are simultaneously depressed, the tone pitch of lower key area is raised or lowered by octave. These processes are executed by this subroutine process PITCH-SW and another subroutine process MIDI-IN which will be described later. In the subroutine process PITCH-SW, the desirable values are respectively set to several registers to be used.

Figure 7:
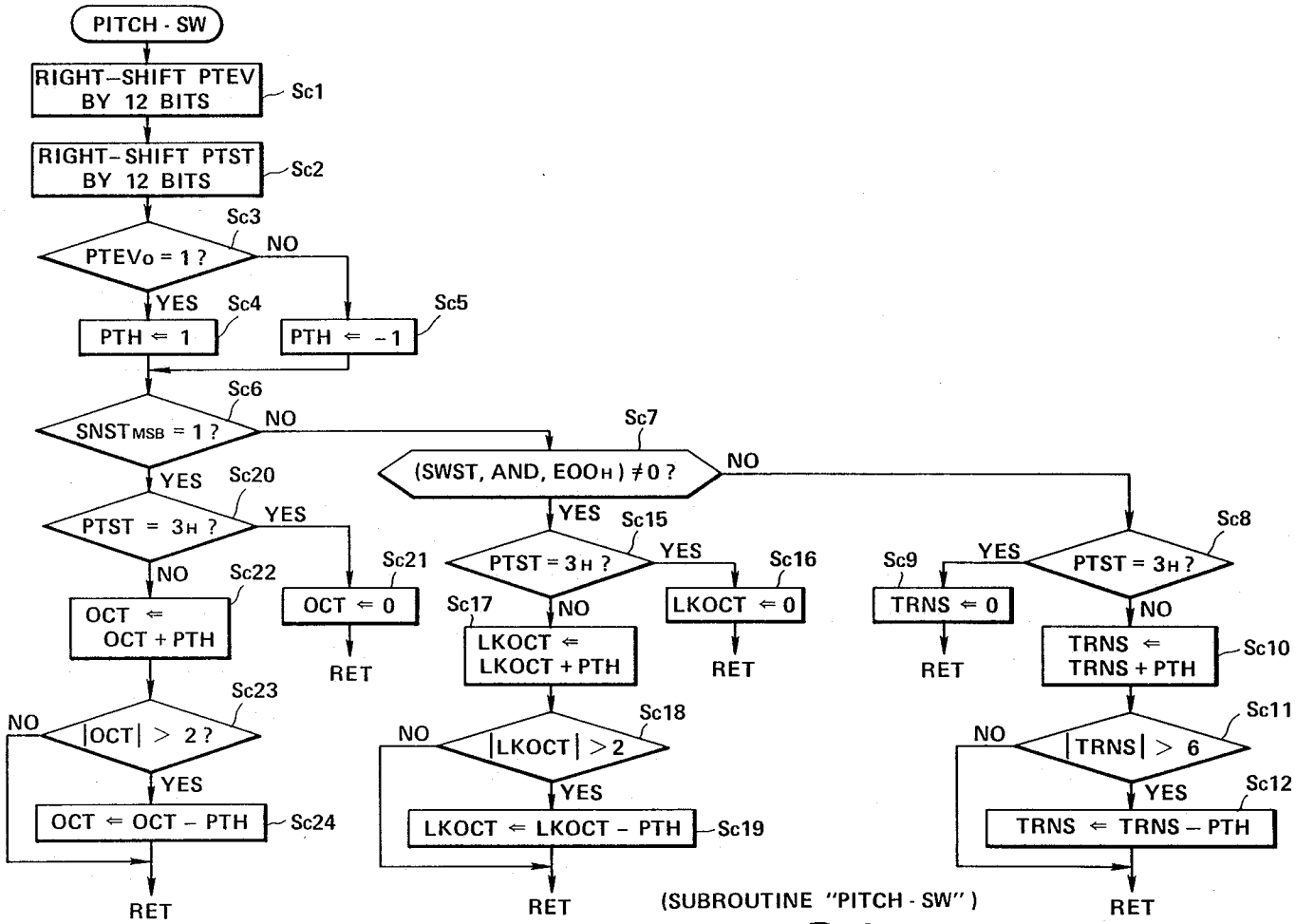

In a first step Sc1 shown in FIG. 7, the data of register PTEV are shifted rightward (i.e., in the lower bit side) by twelve bits. The 12-bit and 13-bit of the data of register PTEV respectively store the on-events of pitch switches PITCH(+) and (−) (see step Sa9) so that these on-events are shifted to its 0-bit and 1-bit positions respectively in the step Sc1. Then, the data of register PTST are shifted rightward in a step Sc2. Similar to the step Sc1, the on/off-events of pitch switches PITCH(+) and (−) are respectively shifted to the 0-bit and 1-bit of register PTST. Next, processing proceeds to a step Sc3 wherein it is judged whether the 0-bit of register PTEV (i.e., $PTEV_0$) stores the value "1" or not. When the pitch switch PITCH(+) is depressed, the judgement result of this step Sc3 turns to "YES" so that the value "1" is written into a register PTH in a step Sc4. On the contrary, when the pitch switch PITCH(−) is depressed, the judgement result of step Sc3 turns to "NO" so that the value "−1" is written into the register PTH in a step Sc5. After executing the step Sc4 or Sc5, it is judged whether the MSB of register SNST takes the value "1" or not in a step Sc6. In other words, it is judged whether the function switch FUNC (see FIG. 1) is turned on or not in the step Sc6. If the judgement result of this step Sc6 is "NO", it is judged whether the logical product between the data of register SWST and data $(0E00)_H$ is equal to "0" or not in a step Sc7. Due to this judging operation of step Sc7, it is judged whether the bass tone color switch (TNSW9 to TNSW11) is turned on or not. When the pitch switch and the bass tone color switch are simultaneously depressed, the judgement result of this step Sc7 turns to "YES". When the pitch switch is only depressed, the judgement result of step Sc7 turns to "NO" so that the processing proceeds to a step Sc8.

In the step Sc8, it is judged whether the data of register PTST are identical to the data $(3)_H$ or not. In other words, it is judged whether two pitch switches PITCH(+) and (−) are simultaneously depressed or not in this step Sc8. When the judgement result of step Sc8 turns to "YES", the processing proceeds to a step Sc9 wherein a register TRNS is cleared. On the other hand, when the judgement result of step Sc8 is "NO", the processing proceeds to a step Sc10 wherein the data of register TRNS are added to the data of register PTH and then its addition result is rewritten into the register TRNS again. In a next step Sc11, it is judged whether the absolute value of data stored in the register TRNS exceeds over the value "6" or not. If the judgement result of this step Sc11 is "YES", the processing proceeds to a step Sc12 wherein the data of register PTH are subtracted from the data of register TRNS and then its subtraction result is rewritten into the register TRNS again. Thus, the addition operation in the step Sc10 is canceled in the step Sc12. Because, in the present embodiment, the raising and lowering movement of tone pitch (i.e., tone pitch transfer) which is executed in accordance with the value of data store in the register TRNS is limited to six half-tones. After executing the step Sc12 or when the judgement result of step Sc11 turns to "NO", the processing returns to the main routine process MAIN again.

Meanwhile, when the judgement result of step Sc7 turns to "YES", the processing proceeds to a step Sc15 wherein it is judged whether the register PTST stores the data $(3)_H$ or not. When two pitch switches PITCH(+) and (−) are depressed, the processing proceeds to a step Sc16 wherein the register LKOCT is cleared and then the processing will return to the main routine process. On the other hand, when the judgement result of step Sc16 turns to "NO", the processing proceeds to a step Sc17 wherein the data of register LKOCT is added to the data of register PTH so that its addition result is rewritten into the register LKOCT. In a next step Sc18, it is judged whether the absolute value of data stored in the register LKOCT exceeds over "2" or not. If the judgement result of this step Sc18 is "YES", the processing proceeds to a step Sc19 wherein the process for canceling the addition operation in the step Sc17 is executed. Because, the upper or lower changing of tone pitch in the lower key area which is executed in accordance with the data of register LKOCT by octave is limited to two octaves in the present embodiment. After executing the process of step Sc19, the processing will return to the main routine process MAIN.

Meanwhile, when the judgement result of the foregoing step Sc6 turns to "YES", the processing proceeds to a step Sc20 wherein it is judged whether the data of register PTST are identical to the data $(3)_H$ or not. In other words, it is judged whether both of two pitch switches PITCH(+) and (−) are simultaneously depressed or not in this step Sc20. Therefore, when both pitch switches are depressed, the processing proceeds to a step Sc21 wherein the register OCT is cleared. On the contrary, when the judgement result of step Sc20 turns to "NO", the processing proceeds to a step Sc22 wherein the data of register OCT are added to the data of register PTH and then its addition result will be rewritten into the register PTN again. In a next step Sc23, it is judged whether the absolute value of data stored in the register OCT exceeds over the value "2" or not. If the judgement result of this step Sc23 is "YES", the processing proceeds to a step Sc24 wherein the process for canceling the addition operation of step Sc22 is executed. The reason why this step Sc24 is executed is similar to that of the step Sc19. After executing the step Sc24 or when the judgement result of step Sc23 turns to "NO", the processing will return to the main routine process MAIN again.

(4) SUBROUTINE PROCESS MIDI-IN

Next, description will be given with respect to the subroutine process MIDI-IN by referring to FIG. 8.

Figure 8:
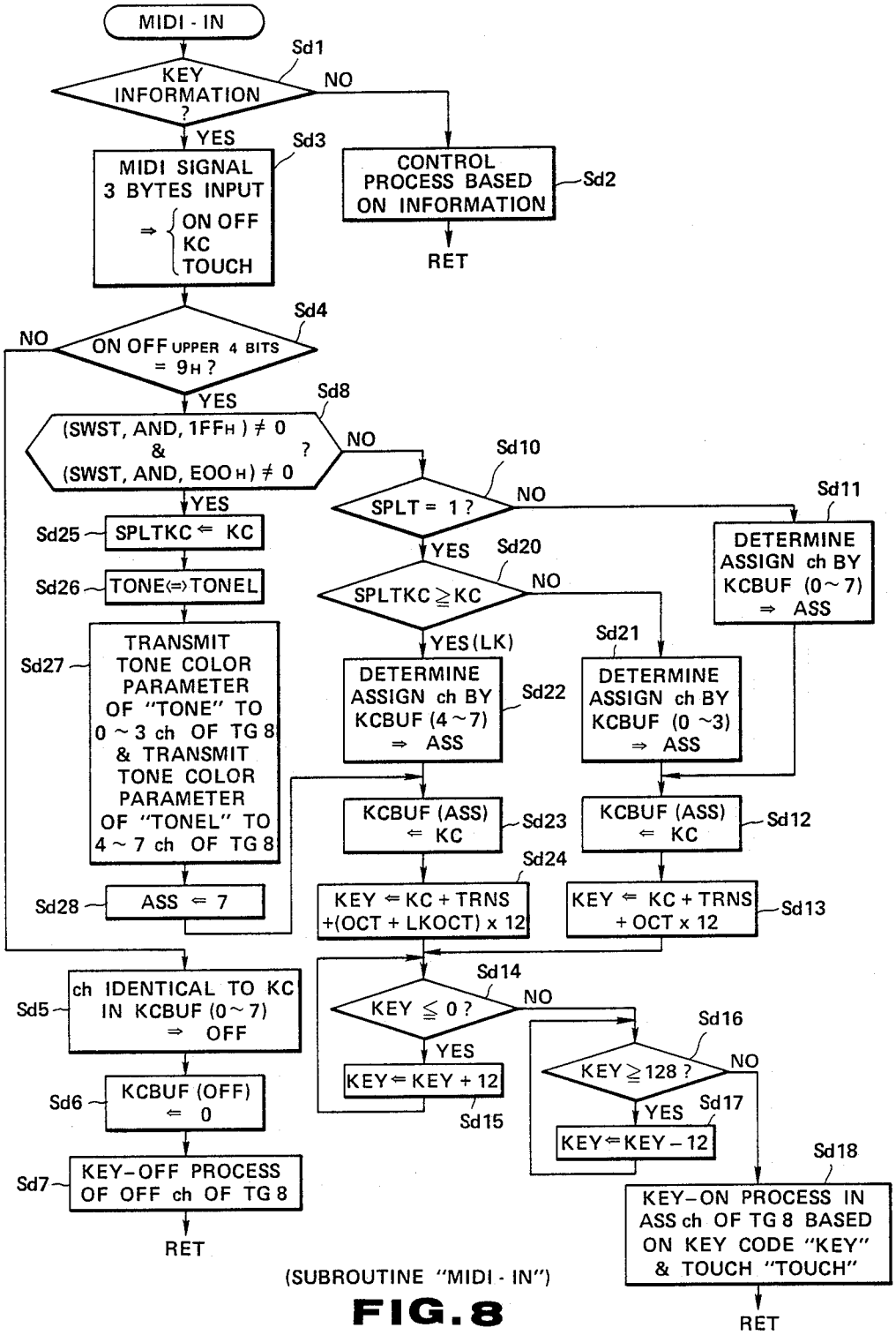

In a first step Sd1 shown in FIG. 8, it is judged whether the MIDI signal which is supplied via the MIDI receiver circuit 2 is the key information or not. If the judgement result of this step Sd1 is "NO", a control process (such as a process for controlling the tone volume and tone color) is executed based on the MIDI information in a step Sd2. On the other hand, when the judgement result of step Sd1 is "YES", the data of three bytes within the MIDI information are inputted, wherein each byte information corresponds to each of the key-on/off information, key code and touch information as shown in FIG. 3. Each of these three bytes is written into each of registers ONOFF, KC and TOUCH. In a next step Sd4, it is judged whether the upper four bits of data stored in the register ONOFF are identical to data $(9)_H$ or not. When the information stored in the register ONOFF designates the key-off, the judgement result of this step is "NO" so that the processing proceeds to a step Sd5. In the step Sd5, the channel number in the key code buffer KCBUF(0 to 7) corresponding to the key code KC in the register KC is written into a register OFF. In a next step Sd6, the key code buffer KCBUF whose channel number is identical to the value of data stored in the register OFF is cleared. In addition, based on the tone-generation channel ch whose number is identical to the value of data stored in the register OFF, the key-off process will be executed in a step Sd7. Thus the key code to which the key-off is designated is subjected to the key-off process. Thereafter, the processing returns to the main routine process MAIN.

When the key-on is designated, the judgement result of step Sd4 turns to "YES" so that the processing proceeds to a step Sd8. In the step Sd8, it is judged whether both of the bass tone color switch (TNSW9 to TNSW11) and tone color switch (TNSW0 to TNSW8) are depressed or not. If the judgement result of this step Sd8 is "NO", the processing proceeds to a step Sd10 wherein it is judged whether the value of the flag SPLT is equal to "1" or not. When the spirit mode is not designated, the judgement result of step Sd10 turns to "NO" so that the processing proceeds to a step Sd11 wherein the tone-generation channel of the key code is determined. This determination is executed by searching the vacant channel within the key code buffer KCBUF(0 to 7), and then the determined channel number is written into register ASS. Then, the key code within the register KC is written into the key code buffer KCBUF whose channel number is identical to that of data stored in the register ASS in a step Sd12. In a next step Sd13, the data of register TRNS are added with the twelve times value of the data of register OCT, and then its addition result is written into a register KEY. Thus, the key code written in the register KEY corresponds to the data of register KC whose tone pitch is raised (or lowered) by octave in accordance with the data of register OCT and also raised (or lowered) by half-tone in accordance with the data of register TRNS.

Next, the processing proceeds to a step Sd14 wherein the value of data stored in the register KEY is equal to or smaller than "0" or not. If the judgement result of this step Sd14 turns to "YES", the processing proceeds to a step Sd15 wherein the data of register KEY are rewritten by the data indicative of the key code which is raised by one octave (+12). Thereafter, the judging operation of step Sd14 is executed again. This process of step Sd15 is repeatedly executed until the judgement result of step Sd14 turns to "NO". The present embodiment does not treat the key codes whose value is smaller than "1" (see FIG. 2), however, there is a possibility in that the key code may take the value lower than "0" by the operation of step Sd13. For this reason, the processes of steps Sd14 and Sd15 are executed. Therefore, when the key code takes the value lower than "0", the key code of register KEY is converted to the key code whose value is proportional to the octaves and whose tone pitch is the lowest but whose value exceeds over "0". Next the processing proceeds to a step Sd16 wherein it is judged whether the value of data stored in the register KEY is equal to or larger than "128" or not. If the judgement result of this step Sd16 is "YES", the processing proceeds to a step Sd17 wherein the key code of register KEY is rewritten by the key code which is lowered by one octave (−12). Then, the process of step Sd16 is executed again. This process of step Sd 17 is repeatedly executed until the judgement result of step Sd 16 turns to "NO". Normally, the present embodiment does not treat the key code whose value is larger than "128", however, there is a possibility in that the key code having the value larger than "128" may be calculated out by the operation of step Sd13. For this reason, the processes of steps Sd16 and Sd17 are executed. In this case, the key code of register KEY is set proportional to the octaves and this key code is converted into the key code whose tone pitch is the highest but whose value is lower than "127".

Meanwhile, when the spirit mode is designated, the judgement result of step Sd10 turns to "YES" so that the processing proceeds to a step Sd20 wherein it is judged whether the key code inputted in the step Sd3 is larger than the key code of register SPLTKC or not. Due to this step Sd20, it is judged whether the musical tone corresponding the inputted key code is generated by the tone color of upper key area or the tone color of lower key area. If the judgement result of this step Sd20 is "NO", the processing proceeds to a step Sd21 wherein the tone-generation channel of the key code buffer KCBUF(0 to 3) is determined and then the data indicative of such determined tone-generation channel are written into the register ASS. Thereafter, the foregoing processes of steps Sd12 to Sd18 are executed so that the tone-generation process will be executed in one of three tone-generation channels ch0 to ch3. Herein, the tone color of these tone-generation channels ch0 to ch3 are set identical to the tone color of upper key area in the steps Sd12 and Sd16. Therefore, the musical tone corresponding to the above key code is generated by the tone color of upper key area.

Next, when the judgement result of step Sd20 turns to "YES", the processing proceeds to a step Sd22 wherein the tone-generation channel number is determined by the data of key code buffer KCBUF(4 to 7) and then the data indicative of such tone-generation channel number are written into the register ASS. In a next step Sd23, the key code is written into the key code buffer KCBUF which is designated by the data of register ASS. Then, the addition operation as shown in FIG. 8 is executed in a step Sd24. This addition operation of step Sd24 is roughly similar to that of step Sd13. However, there is a difference in that the value "12" is multiplied to the sum of the data of register OCT and data of register LKOCT in the step Sd24. As compared to the key code obtained in the step Sd13, the key code obtained in the step Sd24 is larger or smaller by the value of twelve times the data of register LKOCT. Thereafter, the foregoing processes of steps Sd14 to Sd18 are executed, wherein the tone-generation process will be executed in one of the tone-generation channels ch4 to ch7 in the step Sd18. Due to the steps Sb16 and Sb20 shown in FIG. 6, the tone color of lower key area is set as the tone color of tone-generation channels ch4 to ch7. Therefore the musical tone corresponding to the above-mentioned key code will be generated by the tone color of lower key area.

Next, description will be given with respect to the case where the judgement result of step Sd8 turns to "YES". In this case, the key code is supplied from the keyboard 1 (see step Sd1). In addition, both of the tone color switch (TNSW0 to TNSW8) and bass tone color switch (TNSW9 to TNSW11) are depressed. In such case, the processing proceeds to a step Sd25 wherein the key code of register KC is written into the register SPLTKC. As a result, the value of data stored in the register SPLTKC which is initially set identical to the value "54" (i.e., $F\#_2$ tone) will be rewritten. Then, the data of register TONE and the data of register TONEL are exchanged in a step Sd26. In other words, the tone color of upper key area and the tone color of lower key area are exchanged. In a next step Sd27, the tone color parameter which is designated by the data of register TONE is Supplied to the tone-generation channels ch0 to ch3, while another tone color parameter which is designated by the data of register TONEL is supplied to the tone-generation channels ch4 to ch7. Then, the value "7" is written into the register ASS in a step Sd28. Thus, the tone-generation channel ch7 from which the musical tone is to be generated is designated. Thereafter, the processes of steps Sd23, Sd24 and Sd14 to Sd18 are executed so that the musical tone corresponding to the key code of register KC will be generated. Since this key code is assigned to the tone-generation channel ch7, the tone color thereof must be the tone color of lower key area. Due to the above-mentioned processes, the boundary key is newly set in the spirit mode and then its tone is generated, so that it is possible to monitor its tone pitch and tone color. In addition, by executing the process of step Sd26 again, it becomes possible to reset the original tone colors to the lower and upper key areas.

[C] RELATIONS BETWEEN PROCESSING OPERATIONS AND MANUAL OPERATIONS OF SWITCHES

Next, description will be given with respect to the relations between the above-mentioned processing operations and manual operations of switches.

(1) NORMAL PERFORMANCE

Figure 6:
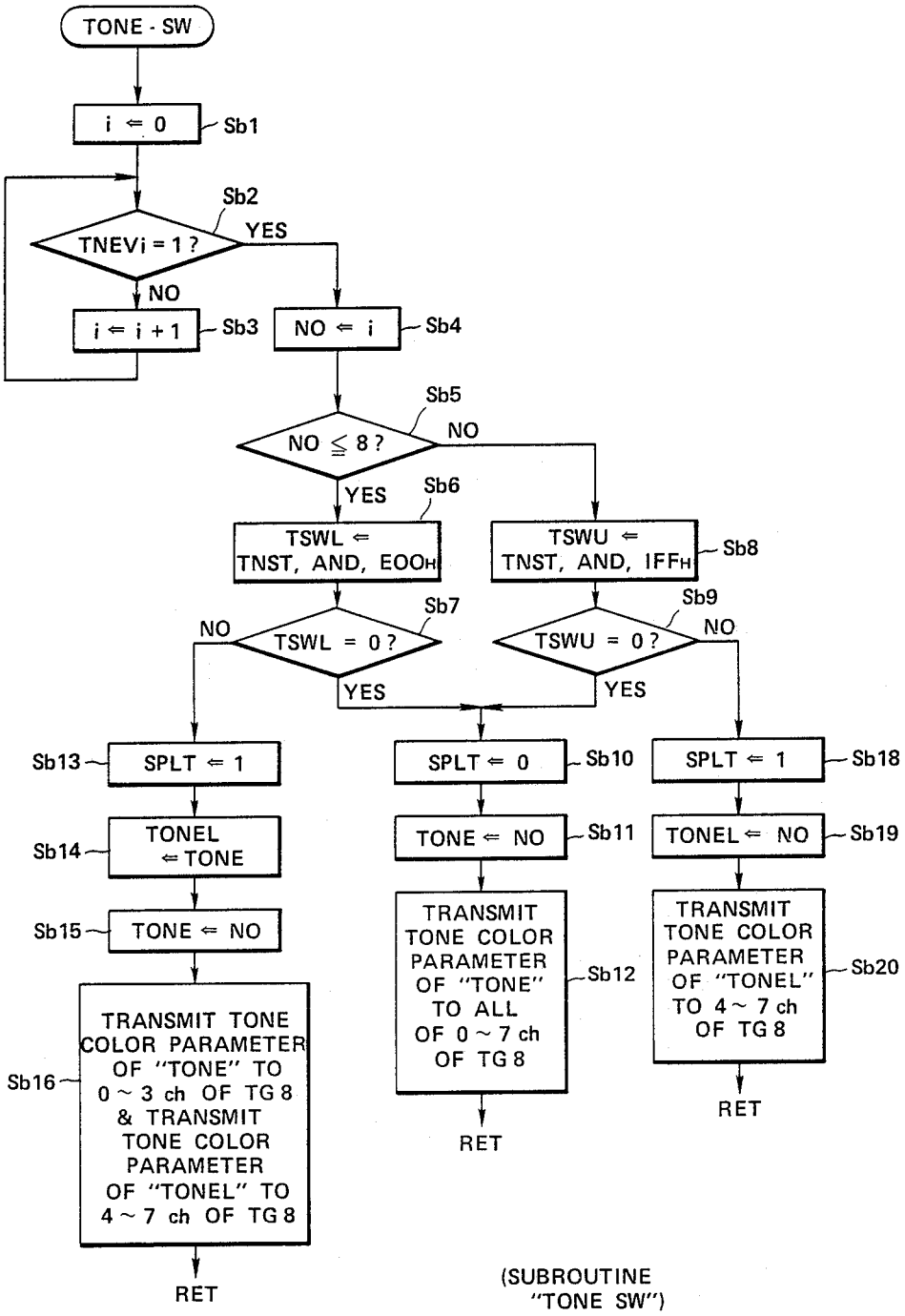
FIGS. 6 to 8 are flowcharts each showing each subroutine process included in the main routine process shown in FIG. 5.

By depressing one of the tone color switches TNSW0 to TNSW11, the processes of steps Sb10 to Sb12 shown in FIG. 6 are executed so that the spirit mode is released (in the step Sb10), whereby the tone color corresponding to the depressed tone color switch is set to the whole key area. In such state, when the keyboard 1 is performed, its key code is outputted so that the processes of steps Sd11 to Sd18 shown in FIG. 8 are executed and then the musical tones corresponding to the performance are generated. Incidentally, when the tone color switch TNSW0 to TNSW11 are not operated at all, the initial tone color "piano 1" is set to the whole key area.

(2) SETTING OF SPIRIT MODE

By depressing both of the tone color switch (TNSW0 to TNSW8) and bass tone color switch (TNSW9 to TNSW11), the subroutine process TONE-SW shown in FIG. 6 is executed by two times so that the spirit mode is set (in the steps Sb13 and Sb18) and the respective tone colors are set to the upper and lower key areas (in the steps Sb12, Sb16 and Sb20). Then, when the player disoperates the tone color switches and then performs the keyboard 1, the assignment of key codes is executed in the step Sd20 shown in FIG. 8 so that the musical tones having different tone colors can be generated in the key areas.

(3) CHANGE IN BOUNDARY OF DIVIDED KEY AREA

When the player depresses any key of keyboard 1 while both of the tone color switch and bass tone color switch are depressed, the key code of the depressed key is written into the register SPLTKC by the process of steps Sd8 to Sd25 shown in FIG. 8. Thus, the boundary key will be changed. In addition, the tone colors of the lower and upper key areas are exchanged in the step Sd26. In order to cancel such exchange of tone colors, the same key of keyboard 1 must be depressed again with depressing the tone color switches.

(4) TONE PITCH TRANSFER AND OCTAVE CHANGE

When the pitch switch PITCH(+) is depressed, the subroutine process PITCH-SW shown in FIG. 7 is started, wherein the value of data stored in the register TRNS will be increased by the process of step Sc10. Then, when the keyboard 1 is performed, the value of register TRNS is added to the value of key code of register KC so that the tone pitch will be transferred in response to its added value. On the contrary, when another pitch switch PITCH(−) is depressed, the value of key code of register KC is decreased instead of increasing in the depressing operation of pitch switch PITCH(+). Thus, the tone pitch is transferred by half-tone.

Meanwhile, when the pitch switch and function switch FUNC are simultaneously depressed, the process of step Sc22 shown in FIG. 7 is executed so that the value of register OCT will be increased (or decreased). Then, when the keyboard 1 is performed, the process of step Sd13 shown in FIG. 8 is executed on the key code of the performed key. Therefore, when present mode is not the spirit mode, the tone pitch of whole key area is changed by octave.

When both of the pitch switch and bass tone color switch are depressed, the process of step Sc7 shown in FIG. 7 is executed so that the value of register LKOCT will be increased or decreased. Then, when the keyboard 1 is performed, the process of step Sd23 shown in FIG. 8 is executed on the key code of performed key so that the tone pitch will be changed by octave. In the spirit mode, the tone pitch of upper key area is changed by octave in the process of step Sd13. Therefore, the tone pitch of each key area can be changed by octave.

[D] MODIFIED EXAMPLES OF EMBODIMENT (1) It is possible to employ the method other than the present method of assigning the tone-generation channels to upper and lower key areas.

(2) In the present embodiment, the combination of tone colors is limited by selecting one tone color corresponding to the switches TNSW0 to TNSW8 and another tone color corresponding to the switches TNSW9 to TNSW11. However, the key area can be divided by the arbitrary combination of two tone colors.

(3) It is possible to arbitrarily designate the range of transferring the tone pitch by octave. In addition, such designation can be executed by use of other switches.

Above is the description of a preferred embodiment of the present invention. This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument providing a key area diving unit comprising:
   (a) a plurality of tone color setting members each designating a predetermined tone color;
   (b) detecting means for detecting a simultaneous operation in which more than two tone color setting members are simultaneously operated;
   (c) means for designating a dividing mode so that a key area of keyboard is divided when said detecting means detects said simultaneous operation;
   (d) musical tone generating means having a plurality of tone-generation channels from which a musical tone signal will be generated in accordance with tone pitch information;
   (e) tone color setting means for setting the tone color designated by tone color setting member to each tone-generation channel in response to divided key area in said diving mode; and
   (f) assigning means for assigning said tone pitch information to each tone-generation channel in response to the divided key area in said dividing mode.

2. An electronic musical instrument providing a tone area changing unit comprising:
   (a) designating means for designating a dividing mode by which a key area of keyboard is divided into first and second key areas;
   (b) means for descriminating the key area so that tone pitch information are divided into first and second tone pitch information having first and second tone areas which are outputted in response to said first and second key areas, said tone pitch information being supplied to said means when said dividing mode is designated;
   (c) tone area changing means for changing said first tone area of said first tone pitch information for said first key area;
   (d) variation designating means for designating a variation of said first tone area which is changed by said tone area changing means;
   (e) first musical tone signal generating means for generating a first musical tone signal based on said second tone pitch information outputted from said means; and
   (f) second musical tone signal generating means for generating a second musical tone signal based on the output of said tone area changing means.

3. An electronic musical instrument according to claim 2 further comprising:
   (a) second tone area changing means for changing said second and first tone areas to thereby supply changed second and first tone pitch informations respectively to said first musical tone signal generating means and said tone area changing means; and
   (b) second variation designating means for designating variations of said first and second tone areas.

4. An electronic musical instrument according to claim 2 further comprising:
   (a) second tone area changing means for changing said second tone area and further changing the changed first tone area which is changed by said tone area changing means to thereby output changed second tone pitch information and further changed first tone pitch information respectively to said first and second musical tone signal generating means; and
   (b) second variation designating means for designating variations of the changed second tone area and the further changed first tone area.

5. An electronic musical instrument comprising:
   (a) a keyboard;
   (b) tone color setting means to which several kinds of tone colors are predetermined in advance so that each of the tone colors can be arbitrarily designated by manual operation of a player, said tone color setting means pre-storing tone color parameters in response to the predetermined tone colors, said tone color parameter being outputted when the corresponding tone color is designated by the player;
   (c) mode designating means capable of designating a dividing mode by which a whole key area of said keyboard is divided into at least first and second key areas;
   (d) means for dividing tone pitch information into first and second tone pitch informations which are to be respectively outputted in response to said first and second key areas in said diving mode, said tone pitch information being generated from said keyboard under performance of said keyboard;

(e) tone pitch changing means for changing a tone area of at least one tone pitch information to thereby output changed tone pitch information in said dividing mode; and (f) musical tone signal generating means having a plurality of channels to which the first and second tone pitch informations are assigned in response to said first and second key areas, whereby each channel generates and outputs a musical tone signal based on the assigned tone pitch information and supplied tone color parameter.

6. An electronic musical instrument according to claim 5 wherein said tone color setting means further comprises:

(a) a plurality of tone color switches to which predetermined kinds of tone colors are respectively assigned so that any one of the tone colors can be arbitrarily selected by manually operating one of said tone color switches; and (b) a table for storing said tone color parameters.

7. An electronic musical instrument according to claim 5 wherein said first said key area is used as a melody key area and said second key area is used as an accompaniment area.

* * * * *